US005388833A

United States Patent [19]

Goyen, Jr.

[11] Patent Number: 5,388,833

[45] Date of Patent: Feb. 14, 1995

[54] GOLF PRACTICE DEVICE

[76] Inventor: Hub W. Goyen, Jr., 8864 E. Sunnyside, Scottsdale, Ariz. 85260

[21] Appl. No.: 191,620

[22] Filed: Feb. 4, 1994

[51] Int. Cl.[6] ..... A63B 69/36

[52] U.S. Cl. ..... 273/187 R; 273/192

[58] Field of Search ..... 273/187 R, 187 A, 187 B, 273/191 R, 192, 187.1; 434/252

[56] References Cited

U.S. PATENT DOCUMENTS 3,868,116 2/1975 Ford et al. ..... 273/187 R X
5,007,646 4/1991 Baber et al. ..... 273/192 X
5,152,534 10/1992 Sindelar ..... 273/192
5,171,017 12/1992 Betancourt ..... 273/187 R
5,180,168 1/1993 Balestrieri ..... 273/187 R
5,190,284 3/1993 Diaz ..... 273/187 R X

*Primary Examiner*—George J. Marlo
*Attorney, Agent, or Firm*—Harry M. Weiss

[57] ABSTRACT

A channel has a plurality of similar grooves in an inside surface of one side. The grooves extend perpendicularly to the edge of the inside surface. The outside surface of the side carries channel indicia of golf club types. A directional arm in the general shape of a picket has a tongue on one side with a shape complementary to the shape of a portion of the groove. The opposite side of the directional arm carries a golf ball placement indicium in the shape of an arrow.

13 Claims, 2 Drawing Sheets

GOLF PRACTICE DEVICE

FIELD OF THE INVENTION

This invention relates generally to sports equipment and methods therefore and, more specifically, to a golf teaching tool and method therefor.

DESCRIPTION OF THE PRIOR ART

A golfer often tries to achieve golfing proficiency by repetitive practice with minimal help from a competent instructor. However, for reasons given hereinafter, the golfer usually practices improper golfing technique with predictably undesired results.

One aspect of golfing relates to placement of a golf ball relative to the golfer. It should be understood that proper placement of the golf ball depends upon which iron or wood the golfer contemplates using. Since there often are as many as eleven irons and five woods, it is not unusual for the golfer to unknowingly place the golf ball improperly in the absence of the instructor.

Another aspect of golfing relates to putting. The golfer may, for example, forget the desired length of a stroke of the putter for a given distance of the golf ball from a target hole. Additionally, the golfer may putt the golf ball in a wrong direction because of an inadequate follow through of the stroke. In the absence of the instructor, it is not unusual for the golfer to practice improper putting technique.

Accordingly, there is a need for a golf teaching tool that obviates frequent services of the instructor. Additionally, it is desirable that the teaching tool be of a size and shape that renders it portable in a golf bag, for example.

SUMMARY OF THE INVENTION

An object of the present invention is to provide a golf teaching tool that enables a golfer to practice proper usage of a golf club and a method therefor.

Another object of the present invention is to provide a golf teaching tool that indicates a preferred placement of a golf ball prior to a golfer hitting the ball with a golf club and method therefore.

Another object of the present invention is to provide a golf teaching tool that indicates a preferred length of a stroke of a putter and method therefore.

Another object of the present invention is to provide a golf teaching tool that is portable in a golf bag and method therefore.

BRIEF DESCRIPTION OF THE PREFERRED EMBODIMENT

According to the present invention, a guide bar is comprised of a channel that has a length of at least of two feet. An inside surface of one side of the channel has a groove therein that extends to an edge thereof. An outside surface of the other side of the channel carries a channel indicium of a type of golf club. One side of a directional arm has a tongue at one end with a shape that is substantially complementary to the shape of at least a portion of the groove. The opposite side of the directional arm carries a golf ball placement indicium.

The present invention informs a golfer of the proper position of a golf ball when the golfer practices using either an iron or a wood to hit the ball. Additionally, the invention provides a tracking board that is used by the golfer to practice putting.

Other objects, features, and advantages of the present invention will be apparent from the following description of the preferred embodiment thereof as illustrated in the accompanying drawing.

DESCRIPTION OF THE PREFERRED EMBODIMENT

A golfer performs on a golf course in conformity with prior repetitive practice. In other words, when the golfer repetitively executes proper golfing technique in practice, the proper technique is executed on the golf course. The present invention is a portable teaching tool that enables the golfer to repetitively practice executing proper golfing technique.

One aspect of the present invention relates to placement of a golf ball relative to the golfer prior to the golfer hitting the ball with either a wood or an iron. Another aspect of the invention relates to putting.

Figure 3B:
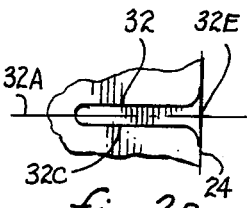
FIG. 3B is a view of FIG. 3A taken along the line 3B—3B with parts broken away.
Figure 3A:
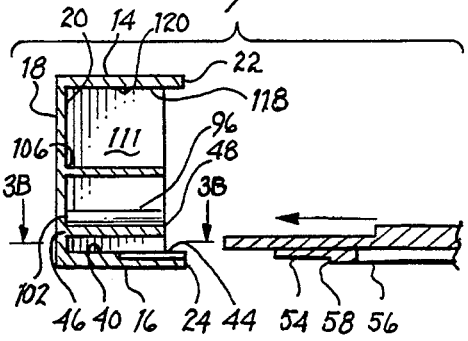
FIG. 3A is a view of FIG. 1 taken along the line 3A—3A with parts broken away.
Figure 1:
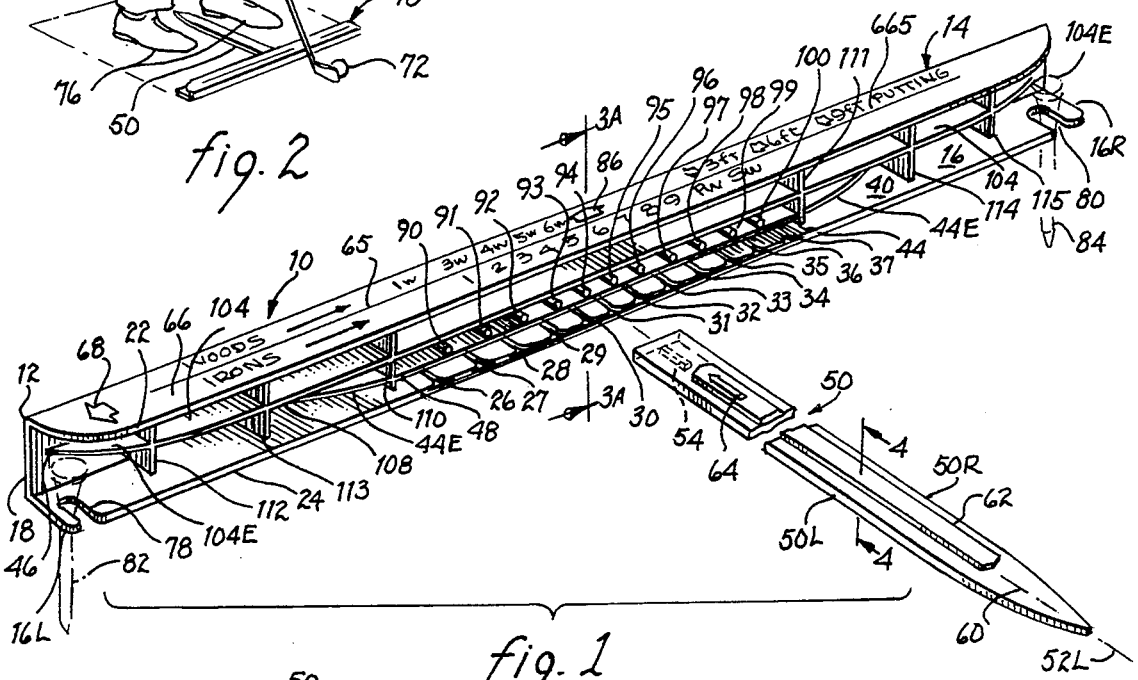
FIG. 1 is a perspective view of the preferred embodiment of the present invention.

As shown in FIGS. 1, 3A and 3B, a golf training tool is comprised of a guide bar 10 that includes a channel 12 that has parallel sides 14, 16 of substantially equal width. Additionally, channel 12 has a bottom 18. Preferably, guide bar 10 is fabricated as an injection molded high impact plastic.

The depth of channel 12 is defined as a displacement from an outer edge 22 of side 14 to a surface 20 of bottom 18. Alternatively, the depth is defined as a displacement from an outer edge 24 of side 16 to surface 20. The distance between ends 16L, 16R of side 16 is two feet. Hence, channel 12 has a length of two feet.

Side 16 has similar parallel grooves 26–37 in a surface 40 thereof. Grooves 26–37 extend from edge 24 to approximately one half the depth of channel 12. Moreover, the central longitudinal axes of grooves 26–37 are perpendicular to edge 24. Spacing between grooves 26–37 is explained hereinafter.

Exemplary of all of grooves 26–37, groove 32 (FIG. 3B) has a longitudinal axis 32A. Additionally, groove 32 has a flared entry portion 32E that is contiguous with a principal portion 32C of groove 32. As explained hereinafter, entry portion 32E facilitates assembly of the training tool.

Within channel 12 is a retention slat 44 with arcuate end sections 44E that are similar to each other. Slat 44 has an edge 46 integrally connected to surface 20. Additionally, slat 44 is parallel to surface 40. Unlike edges 22, 24 an outer edge 48 of slat 44 is at about one fourth of the depth of channel 12.

Figure 6:
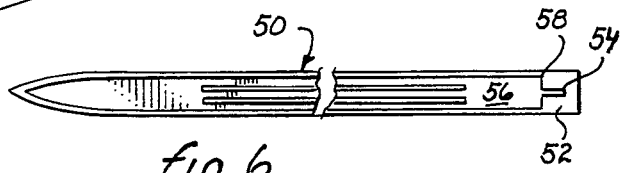
FIG. 6 is a view of FIG. 5 taken along the line 6—6.

As shown in FIG. 6, the training tool additionally includes a directional arm 50 in the general shape of a picket. Arm 50 has a width that is substantially equal to the distance between sides 14, 16.

A bottom side 52 of arm 50 has a tongue 54 integral therewith. Like guide bar 10, arm 50 is preferably fabricated from an injection molded high impact plastic.

Tongue 54 has a shape that is substantially complementary to the shape of principal groove portion 32C. Because of the complementary shape, tongue 54 may be inserted into any of grooves 26–37, whereby the training tool is assembled. The flared entry sections of grooves 26–37 facilitates the insertion of tongue 54.

Side 52 has a raised surface 56 that forms a boundary 58 near tongue 54. When, for example, tongue 54 is inserted into groove 32, a lengthwise axis 50L of arm 50 is perpendicular to channel 10 and a top side 60 (FIG. 1) of arm 50 is in slidable contact with slat 44. Additionally, boundary 58 abuts edge 24 (FIG. 3A). Therefore, tongue 54 is securely maintained within groove 32.

Top side 60 has a longitudinal raised section 62 that is substantially midway between edges 50L, 50R of arm 50. Section 62 carries a golf ball placement indicium 64 in the shape of an arrow.

Side 14 carries channel indicia on a surface 66 that includes a directional indicium 68 in the shape of an arrow. Whenever the teaching tool is used, indicium 68 should point towards a target hole.

Figure 4:
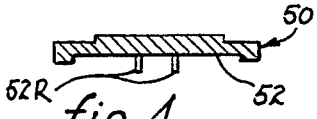
FIG. 4 is a view of FIG. 1 taken along the line 4—4.
Figure 5:
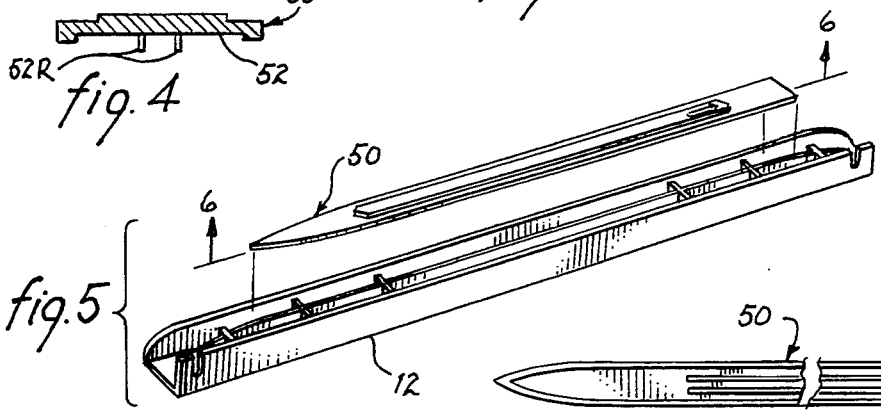
FIG. 5 is a perspective view of a guide bar and a directional arm of the embodiment of FIG. 1.

As shown in FIG. 4, longitudinal ridges 52R are integrally connected to side 52. Ridges 52R have a frictional relationship with the ground, thereby maintaining the teaching tool against inadvertent rotation.

The channel indicia additionally include the word, woods, and an arrow pointing to the characters, 1*w*, 3*w*, 4*w*, 5*w*, 6*w*. When tongue 54 is inserted into grooves 26–30, indicium 64 points towards characters 1*w*, 3*w*, 4*w*, 5*w*, 6*w*, respectively.

When, for example, tongue 54 is inserted into groove 28, indicium 64 points towards character 4*w* whereby the teaching tool indicates placement of the golf ball when the golfer contemplates using a number four wood. More particularly, the ball is placed opposite the character, 4*w*. In a similar manner, placement of the golf ball is indicated when the golfer contemplates using either a number one, three, five or six wood.

Figure 2:
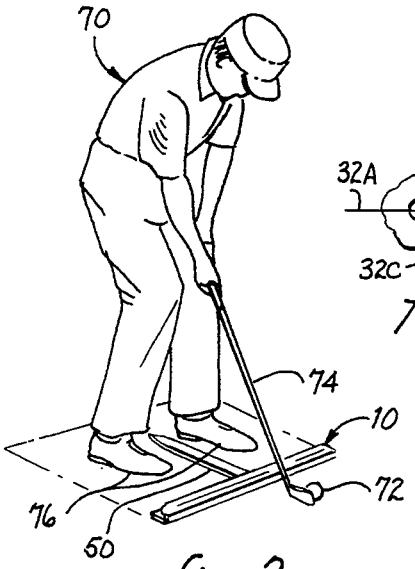
FIG. 2 is a perspective view of a golfer using the embodiment of FIG. 1 to practice using an iron.

As shown in FIG. 2, a golfer 70 contemplates hitting a golf ball 72 with a number six iron 74 while straddling arm 50. As known to those skilled in golfing, feet 76 of golfer 70 are preferably less than two feet apart. Since the length of guide bar 10 is two feet, an indication is provided of when feet 76 are more than two feet apart. It should be understood that a desired position of feet 76 remains unchanged regardless of which iron or wood is used. It is the position of ball 72 that changes in accordance with which one of grooves 26–37 that tongue 54 is inserted into.

Figure 7:
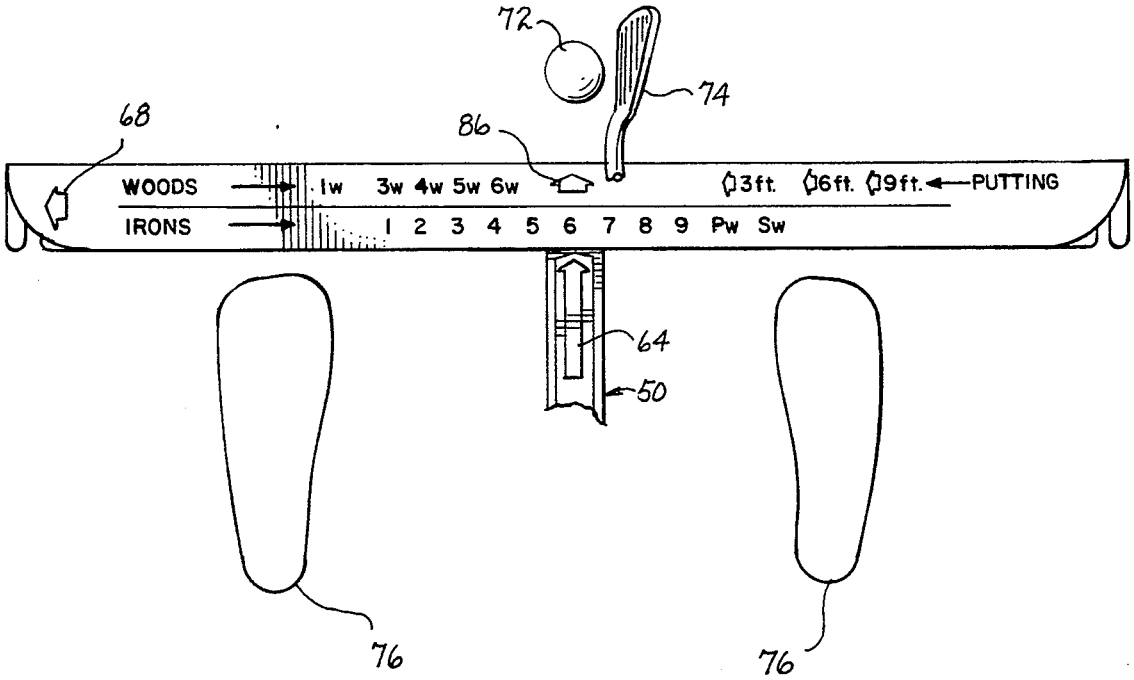
FIG. 7 is a plan view of the embodiment of FIG. 1 assembled to enable a golfer to alternatively practice putting or practice using a number six iron.

The channel indicia additionally includes the word, irons, and an arrow pointing to numerals 1–9 and the designations, Pw, Sw. As shown in FIG. 7, when, for example, indicium 64 points towards the numeral, 6, the teaching tool indicates placement of ball 72 when golfer 70 (FIG. 2) contemplates hitting ball 72 with number six iron 74. In a similar manner, placement of ball 72 is indicated when golfer 70 contemplates hitting ball 72 with irons numbered one through five, seven through nine, a pitching wedge and a sand wedge.

It should be understood that there is no known mathematical relationship between a preferable position of ball 72 relative to golfer 70 and a club that golfer 70 contemplates hitting with. Hence, the spacing of grooves 26–37 is determined empirically.

Figure 8:
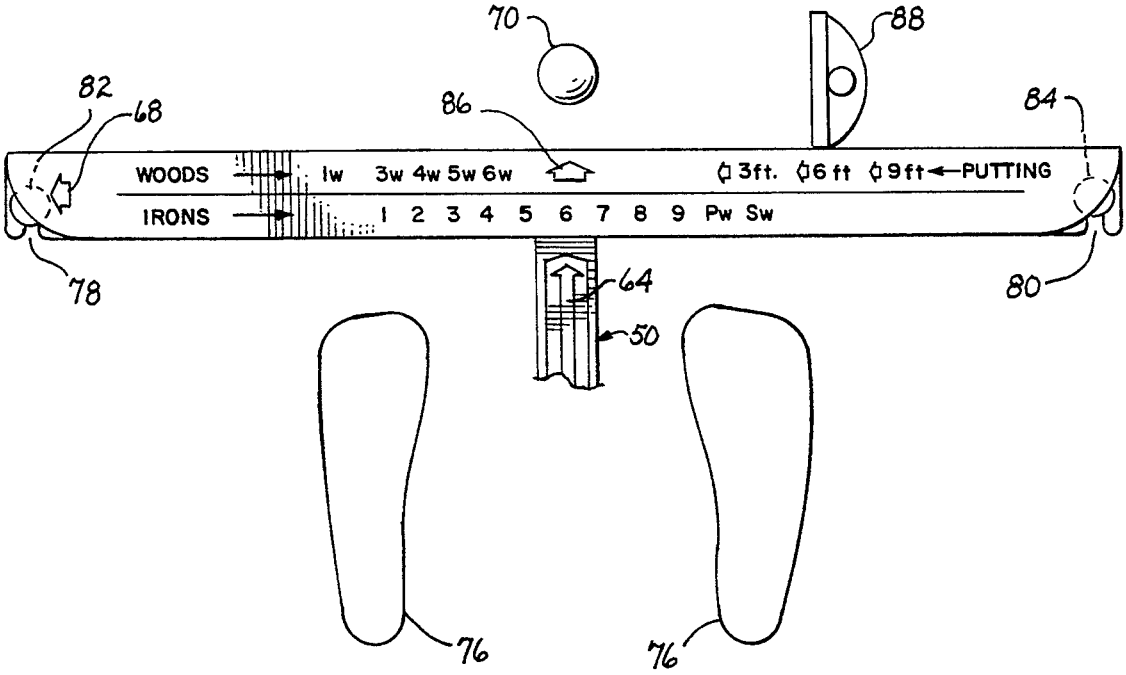
FIG. 8 is a plan view of the embodiment of FIG. 1, assembled in accordance with FIG. 7, with a putter positioned to hit a ball to a target hole that is at a distance of approximately six feet.

As shown in FIG. 8, when the teaching tool is used for putting, tongue 54 (FIG. 1) is inserted into groove 32. Additionally, side 16 has slots 78, 80 through which golf tees 82, 84, respectively, pass. Tees 82, 84 are embedded in sod beneath side 16 whereby the teaching tool is maintained against movement during putting.

The channel indicia further includes the word, putting, and an arrow pointing to designations of 9 ft, 6 ft, and 3 ft, each of which is followed by an arrow. The channel indicia additionally includes an arrow 86 that is codirectional with indicium 64 and a separation line 66S that separates indicia related to woods and putting from indicia related to irons.

Ball 72 is placed opposite arrow 86. When the target hole is approximately six feet from ball 72, a putter 88 has its head placed in slidable contact with bottom 18 opposite the 6 ft designation. Golfer 70 slides the head of putter 88 along bottom 18 to contact ball 72. The sliding of the head of putter 82 is with a single stroke that includes a follow through that is at least as least as long as the displacement between the 6 ft designation and ball 72. In other words, the teaching tool serves as a tracking board when the golfer practices putting.

In a manner similar, golfer 70 practices putting to target holes at distances of approximately three feet and nine feet from ball 72. It should be understood that respective locations of the 3 ft, 6 ft and 9 ft designations are based upon needs of an average golfer. Adjustment of the length of the putting stroke may be desirable for a particular golfer.

As shown in FIG. 6, since the width of arm 50 is substantially equal to the distance between sides 14, 16 and outer edge 48 (FIG. 1) is at about one fourth of the depth of channel 12, arm 50 fits into channel 10. When arm 50 is within channel 12, a package is formed that conveniently fits into a golf bag.

Structural rigidity of channel 10 and slat 40 causes tongue 54 to be securely retained within any of grooves 26–37. The structural rigidity is additionally desirable to prevent structural distortion of the teaching tool when it is inadvertently bumped against golf clubs while stored in a golf bag. There are three structural features that are included for maintaining the rigidity.

A first structural rigidity feature is comprised of similar cylindrical stays 90–100. Exemplary of all of stays 90–100, the side of stay 96 is integrally connected to slat 40 (FIG. 3A). Additionally, an end 102 of stay 96 is integrally connected to surface 20. Preferably, stays 90–100 are spaced to cause orthogonal projections thereof to lie midway between adjacent central longitudinal axes of grooves 20–31, respectively.

A second structural rigidity feature is comprised of a support slat 104 that has arcuate ends 104E. Slat 104 is parallel to surface 32. Because ends 104E are arcuate, slots 78, 80 are not occluded when tees 82, 84 pass therethrough.

An edge 106 of slat 104 is integrally connected to surface 20 (FIG. 3A). In a manner similar to slat 44, an edge 108 of slat 104 is at about one fourth of the depth of channel 10.

A third structural rigidity feature is comprised of vertical support plates 110–115 that are substantially perpendicular to surface 40. Exemplary of all of plates 110–115, a top edge 118 of plate 111 (FIG. 3A) is integrally connected to a surface 120 of side 14. A bottom surface 122 of plate 111 is integrally connected to surface 40 (FIG. 1).

Plates 110, 111 are disposed laterally adjacent to grooves 26, 37, respectively, and are integrally connected to sides 14, 16 and slats 44, 104. Plates 112, 113 are disposed with substantially equal spacing between plate 110 and end 16L and are integrally connected to slat 104. Similarly, plates 114, 115 are disposed with equal spacing between plate 111 and end 16R and are integrally connected to slat 104.

While the invention has been particularly shown and described with reference to a preferred embodiment thereof, it will be understood by those skilled in the art that changes in form and detail may be made therein without departing from the spirit and scope of the invention.

I claim:

1. A golf teaching tool that indicates placement of a golf ball relative to a golfer, comprising:

a channel having a groove in an inside surface of one side of said channel, an outside surface of the other side of said channel carrying a channel indicium of a golf club type, the length of said channel being at least two feet; and a directional arm that has a tongue connected thereto at one end, said tongue having a shape substantially complementary to the shape of at least a portion of said groove, one side of said arm carrying a golf ball placement indicium of placement of said ball when said tongue is inserted into said groove.

2. The teaching tool of claim 1 wherein said channel is fabricated from a high impact injection molded plastic.

3. The teaching tool of claim 1 wherein said arm is fabricated from a high impact injection molded plastic.

4. The teaching tool of claim 1 wherein the outside surface of said other side of said channel carries a putting indicium of a length of a stroke of a putter to hit said ball to a target hole at a known distance therefrom.

5. The teaching tool of claim 4 additionally comprising a plate substantially perpendicular to said inside surface, said plate integrally connected to the interior of said channel.

6. The teaching tool of claim 1 wherein said groove is perpendicular to an outer edge of said one side.

7. The teaching tool of claim 1 additionally comprising a retention slat connected to the interior of said channel, said retention slat being in slidable contact with said arm when said tongue is within said groove.

8. The teaching tool of claim 7 wherein a cylindrical stay is connected to said retention slat and to the bottom of said channel.

9. The teaching tool of claim 7 additionally comprising a plate substantially perpendicular to said inside surface, said plate being integrally connected to the interior of said channel and to said retention slat.

10. The teaching tool of claim 7 wherein an outer edge of said retention slat is at about one fourth of the depth of said channel.

11. The teaching tool of claim 10 wherein the width of said arm is substantially equal to the distance between said sides of said channel.

12. The teaching tool of claim 7 wherein the other side of said arm is integrally connected to a longitudinal ridge.

13. The teaching tool of claim 1 wherein said arm has the general shape of a picket and a lengthwise axis thereof is perpendicular to said channel when said tongue is within said groove.

* * * * *